United States Patent [19]

Van Zandt

[11] 4,064,428

[45] Dec. 20, 1977

[54] CHEMICAL LIGHT DEVICE

[75] Inventor: Richard Taylor Van Zandt, Bridgewater, N.J.

[73] Assignee: American Cyanamid Company, Stamford, Conn.

[21] Appl. No.: 737,875

[22] Filed: Nov. 1, 1976

[51] Int. Cl.[2] ..... F21V 9/16

[52] U.S. Cl. ..... 362/34; 222/94

[58] Field of Search ..... 240/2.25; 250/462; 222/94, 95, 541

[56] References Cited

U.S. PATENT DOCUMENTS

| | | | |
|---|---|---|---|
| 3,576,987 | 5/1971 | Voight et al. | 240/2.25 |
| 3,584,211 | 6/1971 | Rauhut | 222/94 X |
| 3,813,534 | 5/1974 | Gilliam | 222/94 X |
| 3,829,678 | 8/1974 | Holcombe | 240/2.25 X |

*Primary Examiner*—R. L. Moses

*Attorney, Agent, or Firm*—Gordon L. Hart

[57] ABSTRACT

Chemical light device has oxalate and peroxy components in compartments separated by frangible means which is broken upon rapid acceleration or deceleration by a movable object within the device. The movable object is restrained until released by extraordinary acceleration.

10 Claims, 10 Drawing Figures

CHEMICAL LIGHT DEVICE

Figure 1:
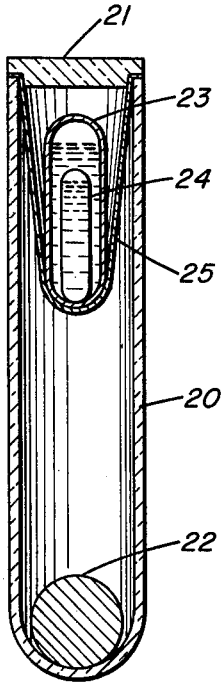

The invention relates to an improved chemiluminescent lighting device. Several devices have been proposed having separate compartments within a closed translucent tube or other container, each compartment holding one of the components of a chemiluminescent mixture. Means are provided for breaking a barrier which separates the inner compartments to mix the several components within the outer translucent container. The mixture of components generates chemiluminescent light. U.S. Pat. Nos. 3,576,987 and 3,875,602 described devices having frangible inner compartments, e.g., long glass ampules which were broken by flexing the outer translucent container, e.g., a polyethylene tube. U.S. Pat. No. 3,813,534 described a similar device having two sealed glass ampules with one end of one of the ampules arranged to seal one end of the other ampule. Both ampules were contained in an outer translucent tube. A weight such as a cylindrical glass rod was placed to move freely inside one of the two ampules, so that when the device was launched from a launcher, the inertia of the weight would cause the end of the other ampule to strike the weight. This impact would break the ampule permitting the separated chemiluminescent components to mix and produce light.

The present invention is an improvement which uses the inertial momentum of movable parts within the tube to break the barrier which separates the chemiluminescent components in their respective compartments. The invention has several advantages over the device described in U.S. Pat. No. 3,813,534. In that earlier device, a weighted striking object, i.e., the glass rod, was free to move within the confines of one of the ampules inside the tube at all times. The invention, by way of comparison, employs positive restraining means to restrain the free movement of the movable part until the movable part bears against its restraint with inertial force which exceeds the yield limit of the restraint and breaks the restraint. The restraint will hold the movable part securely to prevent random breakage by the force of incidental bumps and jolts such as those ordinarily encountered in transport and handling. The restraint however will yield to a greater force, releasing the part for free movement within the tube. Such greater force is the inertial force generated upon a very rapid acceleration or deceleration, such as acceleration upon launching of the tube as a missile or upon deceleration upon impact of the missile striking its target.

The means restraining movement of the movable part in this device may be selected from any of several suitable yieldable restraints, such as frictional clips, collars, fingers and other frictional holding means or from breakable restraints such as sleeves, membranes and the like. Other such restraining means may be used that will yield by slippage, breaking, tearing, or the like under a predetermined force exceeding a predetermined limit. The invention comprises a movable object that is restrained within the tube. This movable object may comprise the barrier means, such as one or several frangible containers such as glass ampules in which separate components are contained. Alternatively, the movable object might be a striking means such as a glass rod, a ball of steel or another weighted object that will break, sever, pierce or otherwise remove a barrier upon collision therewith.

The restraining means is designed with strength sufficient to restrict movement of the movable part and thereby prevent its collision with other parts until the inertial force of the movable part bearing against the restraint exceeds a predetermined limit, whereupon the restraint yields. The limited yield strength of the restraint is strong enough to resist yield under ordinary forces encountered in handling but it is weak enough to yield under a linear inertia of the magnitude generated in the movable part by the acceleration of launching or the deceleration of target impact. The design yield limit will be determined as a function of the mass of the restrained object, i.e. the movable part, the incidental accelerations the restraint is expected to resist and the expected activating acceleration. The restraint is then designed to yield at the calculated limit.

Several specific embodiments of the invention are illustrated in the drawings.

FIGS. 1 – 9 are cut-away sectional views of several lighting devices embodying the invention.

In all of the figures, the outer container is a tube 20 which is a hollow tube closed at one end and sealed at the opposite end by a plug 21. This tube 20 is of a translucent material of strength sufficient to contain the working elements inside and to withstand the rigors of service. We prefer a strong transparent plastic material for this container, such as polyethylene, polycarbonate or the like. The plug 21 is preferably also of a translucent material but this is not required. In all of the figures except FIG. 7 a striking object 22 is shown as a steel ball but any other object of suitable material and shape for a particular design might be used instead. Other striking objects such as glass or metal rods, ceramic marbles, and other hard objects can be used. In all of the Figures, the barrier means for separating the chemiluminescent components are shown as glass ampules, a larger ampule 23 containing a first liquid component comprising an oxalate diester and a fluorescer in organic solvent, and a smaller ampule 24 containing a second liquid component comprising a solution of hydrogen peroxide activator and catalyst in organic solvent. On impact with the striking object, the glass ampules 23 and 24 are fractured, whereupon the liquid components from both ampules combine within the outer tube 20 and generate chemiluminescent light which radiates from the translucent container.

In FIGS. 1–5 and 8, the striking object 22 is a steel ball having about the same diameter as the inside of the outer tube 20. The ball is fixed inside one end of the tube by secure frictional engagement with the tube wall. If necessary the ball may be cemented to fix it in this position. At the other end, inside the tube, the ampules 23 and 24 are secured by one of the several different restraining means shown in FIGS. 1–6 and 8. The two ampules are arranged with the smaller ampule 24 contained within the larger ampule 23. In FIG. 1 the restraining means is a sleeve 25 of polyethylene or other film or sheet material which is secured at its ends by the plug 21 and which forms a pocket inside the outer tube to contain and restrain movement of the ampules. The sleeve 25 is a tube closed at one end, like one finger of a glove. It is formed of a membranous film material of limited strength which will yield by rupture or tearing at the design yield limit. Thus when the device is launched as a missile, the inertia of the confined ampule 23 pressing against the sleeve 25, overcomes the yield limit, breaks the sleeve to free the ampule for movement and impels the ampule towards the striking member fixed at the opposite end of the tube.

Figure 2:
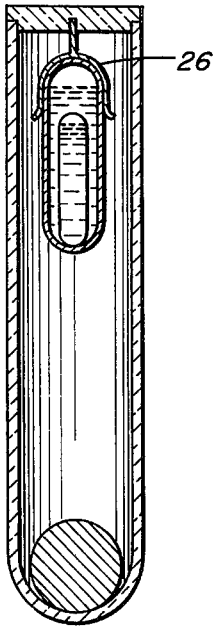
Figure 3:
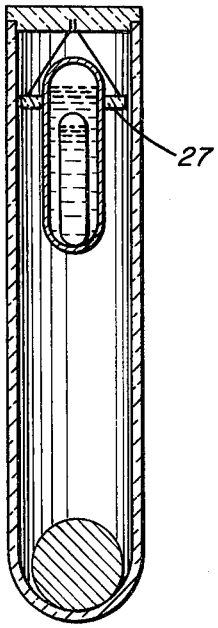

In FIGS. 2–5 each of the devices differs from that shown in FIG. 1 by a different restraining means used in each. In FIG. 2, the restraining means is a spring-clip 26 which engages the larger ampule 23 by frictional engagement of the clip with the ampule walls. The spring-clip, attached to the plug 21, restrains the ampule 23 to prevent forward movement. In FIG. 3 the restraining means is a rubber collar 27 which holds the ampules by frictional engagement around the outer wall of the ampule. The collar 27 is fastened in turn to the plug 21.

Figure 4:
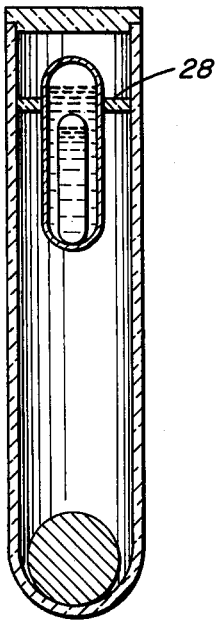

In FIG. 4 another rubber-ring 28 engages the ampule 23 by frictional engagement, as in FIG. 2, but in this embodiment the ring is secured to the inner wall of the tube, either by frictional engagement or by means of cement or the like.

Figure 5:
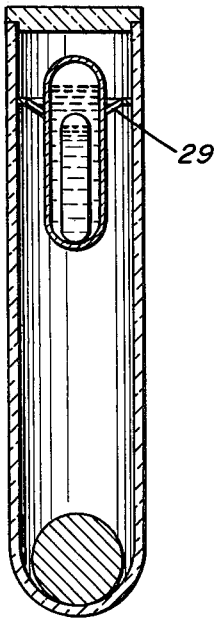
Figure 5A:
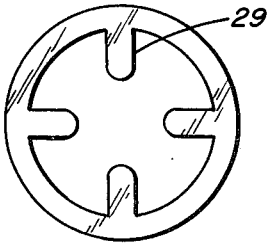

In FIG. 5 a ring secured to the inner wall of tube 20 has several resilient fingers 29, each radially biased inward. The ampule 23 is inserted through the fingers 27 which are thereby flexed elastically, restraining the ampule 23 by the biased frictional engagement of the resilient fingers against the walls of the vial.

Figure 6:
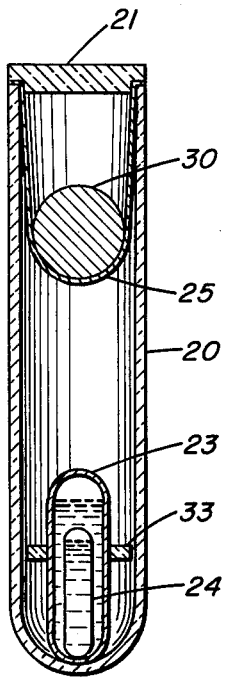

In FIG. 6, a steel ball 30 is somewhat smaller in diameter than the tube, to permit free travel of the ball through the tube. The ball 30 is restrained by a sleeve 25, like those described above, which in this case restricts motion of the ball. At the opposite end of the tube the ampules 23 and 24 are secured to prevent their movement within the tube by a collar fixed to the tube wall. Upon rapid acceleration of the tube, the inertia of the ball 30 will exceed the yield limit of the sleeve 25 and impel the ball against the vials, crushing them.

Figure 7:
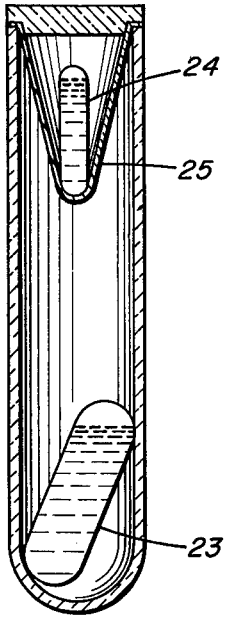

In FIG. 7 one ampule 23 is placed in one end of the tube, preferably fixed there as by cement or the like, and another ampule 24 is held at the other end by a sleeve 25 which functions the same as those sleeves described above. When the sleeve 25 yields, the ampule 24 is hurled by its inertial momentum against the other ampule 23 and both ampules are crushed by the impact. In this embodiment, each of the ampules is the striking means against which the other ampule is struck and broken.

Figure 8:
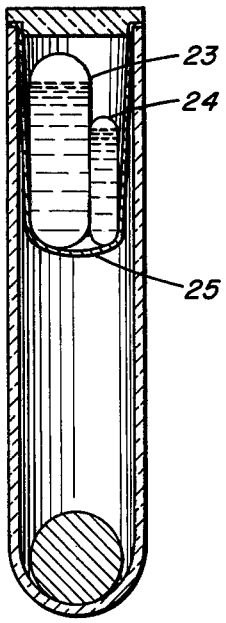

In FIG. 8 the ampules 23 and 24 are separate and both are contained within a sleeve 25 which functions the same as the sleeve 25 described in FIG. 1.

Figure 9:
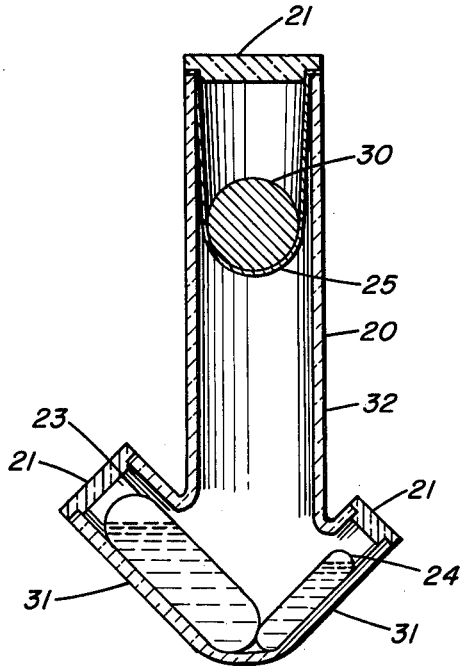

In FIG. 9, a differently shaped translucent container is provided, having three tubular members, all joined at one end of each member to form a continuous inner chamber inside, as shown. Into each of the two smaller tube members 31 is placed one of the ampules 23 and 24, with one end of each ampule extending into the chamber of the larger tube member 32, as shown. The smaller tube members are sealed at their outer ends by plugs 32, after the ampules have been inserted. The ampules are restricted within the small tube members 31, preventing their migration into the larger member 32. At the opposite end of the larger tube member, a steel ball 30 is held by a sleeve 25, the same as described above for FIG. 6. When the sleeve 25 yields upon linear acceleration of the steel ball 30, the ball is dashed against the ampules 23, 24 at the opposite end, thereby crushing both ampules.

The lighting devices described are suitable for launching from a launcher, either as the primary missile or preferably as an attachment on a primary missile vehicle, such as an arrow shot from a bow, or a harpoon from a harpoon gun, or a rocket propelled missile, or the like. The light transmitted by the attached device is useful for locating the missile at the place where it lands, or at whatever place it might be carried by a moving target. The light is particularly useful for locating the missile in darkness. For the purpose of the invention, chemiluminescent formulations are available that can continue to emit visible light for several hours after activation.

The invention is useful with any of a variety of chemiluminescent formulations in which the several components required for a light emitting composition can be kept apart as separately inactive components which are activated only when the inactive components are combined. Many such formulations are known and the invention is useful with almost any. An especially preferred formulation comprises two liquid components, one comprising a solution of an oxalate diester and a fluorescent compound in a liquid solvent, the other comprising a solution of hydroperoxide and catalyst in a liquid diluent. In addition to the two component systems described in the United States patents mentioned above, the two component systems described in U.S. Pat. Nos. 3,557,233, 3,597,362, 3,749,679 and 3,888,786 and at many other literature sources, can be used. A specific activator component, for use in the examples below, is prepared by mixing 773 ml dimethylphthalate, 212 ml tert-butanol and 0.10 g. of sodium salicylate until all dissolved, then adding 53 g. of hydrogen peroxide, 98%. The other component (oxalate component) is prepared by dissolving 90.07 g. bis(2,4,5-trichloro-6-carbopentoxyphenyl) oxalate in 925 ml of high quality dibutyl phthalate and heating the solution under nitrogen for 1 hour. Then cool to 80°–85° C. under nitrogen and add 1.113 g. of 9,10-bis(phenylethynyl)anthracene, cool to room temperature and add dibutylphthalate to make one liter. Use about one part by volume of the activator component with three parts by volume of the oxalate component.

EXAMPLE I

Preparation and Use of the Device of FIG. 1

A cylindrical glass tube (0.2 mm ± 0.02 mm. wall thickness and 7.55 mm. ± 0.01 mm. outer diameter), having one end closed, is charged with 2.0 mls. of the activator component described above and the open end is sealed in a flame to make an ampule about 90 mm. long. A larger cylindrical glass tube (0.4 mm. ± 0.04 mm. wall thickness, and 12.48 mm. ± 0.01 mm. outer diameter) having one end closed is charged with 6.0 mls. of the oxalate component described above. The smaller ampule containing the activator component is inserted inside the larger tube and the open end of the larger tube is then sealed in a flame to make a second ampule about 114.5 mm. long, containing the smaller ampule.

A solid steel ball (10.1 grams; 13.53 mm. diameter) is inserted inside a translucent cylindrical polyethylene tube which is closed at one end. The polyethylene tube is slightly tapered having an outside diameter of about 18.0 mm. at the open end, narrowing to 17.75 mm. outside diameter at a point 76 mm. from the open end and to 17.0 mm. outside diameter at a point 12.5 mm. from the closed end. The wall thickness of the polyethylene tube is 1.6 mm. ± 0.07 mm. and the overall length is 171.5 mm. The steel ball is pressed towards the closed end inside the tube to a point where it is fixed by its frictional engagement with the wall.

The larger ampule is inserted into a bag formed by the closed end of a sleeve of polyethylene film having a thickness of 0.020 to 0.025 mm. and the bag containing the ampule is inserted in the open end of the polyethylene tube. The open end of the sleeve is draped over the rim of the polyethylene tube and held in place by a polyethylene plug which is inserted into the open end of the sleeve and tube. The polyethylene plug, sleeve and wall of the tube are heat-sealed to fix the sleeve and seal the tube.

The device is attached with tape to the shaft of an arrow so that the glass ampules will precede the steel ball in the direction of flight of the arrow. The arrow with the device attached is launched by shooting the arrow from a 40 pound bow, thus accelerating the device and causing the larger ampule to pierce the polyethylene film and impact with the steel ball as the arrow is shot. The glass tubes are shattered upon impact, causing the activator and oxalate components to rapidly mix and emit chemical light by which the device is visible during flight of the arrow.

Another device, made the same, is attached to an arrow with the tube reversed so that the steel ball will precede the glass tubes in the direction of flight of the arrow. The arrow and attached device are launched from a 40 pound bow. The light is not actuated upon launching but is actuated by the deceleration upon impact of the arrow against a target or other object. On such impact the ampule is forced by its inertial momentum through the polyethylene sleeve and it smashes against the steel ball causing both ampules to break. The components are thus mixed to emit chemical light. The arrow, where it comes to rest, is visibly illuminated by the attached lighting device.

EXAMPLE II

Preparation and Use of the Device Shown in FIG. 7

A cylindrical glass tube is charged with 2.0 mls. of the activator component and heat sealed to make a smaller ampule the same as in Example I. The ampule is then inserted into a polyethylene tube of the same dimensions described in Example I and is fixed at the closed end of the tube by means of cement.

A larger glass tube is charged with 6.0 mls. of the oxalate component and heat sealed to make a larger ampule, as in Example I except without the smaller ampule inside. The larger ampule is inserted in a bag formed by a polyethylene sleeve inside the tube at the open end of the tube and the tube is sealed, all as described in Example I.

The device is attached by tape to the shaft of an arrow so that the glass ampule in the bag will precede the smaller ampule in the line of flight of the arrow and the arrow is launched by means of a 40 lb. bow. Acceleration of the device upon launching causes the larger glass ampule to break through the polyethylene sleeve and impact against the smaller glass ampule, thereby breaking both ampules, whereupon the activator and oxalate components mix within the outer container and emit chemical light. The flight of the arrow is traced by a luminous glow from the activated lighting device.

EXAMPLE III

Preparation of the Device Shown in FIG. 6

The procedure of Example I is used to prepare a smaller glass ampule containing the activator component, which is placed inside a larger glass ampule containing the oxalate component. A polyethylene collar is slipped over one end of the larger ampule and fixed to the ampule walls to leave most of the ampule extending outside the collar. The outside diameter of the polyethylene collar with the glass ampule therein is 13.5 mm. The end of the ampule having the collar is inserted into a polyethylene tube of the dimensions described in Example I and is pushed downwardly therein until the collar is wedged securely by the walls of the tapered polyethylene tube, fixing the ampule in that end of the tube.

A solid steel ball (10.1 grams; 13.53 mm. diameter) is carefully inserted into a polyethylene sleeve of the dimensions described in Example I and the sleeve is inserted into the tube so that the open end of the sleeve is draped around the periphery of the wall of the polyethylene tube at the open end. A polyethylene plug is inserted into the open end of the polyethylene tube and the plug, sleeve, and wall of the tube are sealed together by heating.

The device is attached to the shaft of an arrow so that the steel ball will precede the glass ampule in the line of flight. The arrow is launched by means of a 40 lb. bow. Acceleration of the device upon launching causes the steel ball by its inertia to break through the polyethylene sleeve, travel through the tube and impact against the fixed glass ampules causing the tubes to break. The chemical components are thus combined and emit light.

I claim:

1. A chemiluminescent lighting device comprising a translucent container and contained therein:

a. several inactive components of an active chemiluminescent mixture, b. barrier means separating said several components in several compartments within said container, said barrier means being breakable by impact with a striking means to combine said components, c. striking means for breaking said barrier means by impact therewith, d. a movable part that is movable within said container when said movable part is free and means restraining the free movement of said movable part within said container until the linear momentum of said movable part bearing against said restraining means exceeds a predetermined yield limit, whereupon said restraining means will yield and release said movable part for free movement, e. the said striking means, barrier means and movable part being located in relation to each other within said container so that when said movable part is released for free motion, within said tube said movable part will be impelled to bring together said barrier means and said striking means with impact sufficient to break said barrier means.

2. A chemiluminescent lighting device defined by claim 1 wherein said barrier means consists of a plurality of glass ampules each enclosing one of the respective inactive components.

3. A chemiluminescent lighting device defined by claim 2 wherein the defined movable part consists of at least one of said glass ampules.

4. A chemiluminescent lighting device defined by claim 3 wherein one of the defined glass ampules is contained within another of said ampules which is the defined movable part.

5. A chemiluminescent light device defined by claim 3 wherein the defined striking means consists of another one of said glass ampules.

6. A chemiluminescent device defined by claim 3 wherein the defined striking means is a steel ball.

7. A chemiluminescent device defined by claim 6 wherein one of said ampules is sealed inside the one of said glass ampule which is the moving part.

8. A chemiluminescent device defined by claim 2 wherein said movable part is also said striking means.

9. A chemiluminescent device defined by claim 8 wherein said movable part striking means is a steel ball.

10. A chemiluminescent device defined by claim 8 wherein said restraining means is a bag of breakable film fixed in said container and containing said movable part striking means.

* * * * *